United States Patent [19]

Himmelrich

[11] Patent Number: 4,474,262

[45] Date of Patent: Oct. 2, 1984

[54] DESCENT WITH MANUALLY OPERABLE BRAKE

[75] Inventor: Lewis H. Himmelrich, Costa Mesa, Calif.

[73] Assignee: Michael Bell, Warrington, Pa.

[21] Appl. No.: 390,131

[22] Filed: Jun. 18, 1982

[51] Int. Cl.[3] ..... A62B 1/14

[52] U.S. Cl. ..... 182/5; 188/65.5

[58] Field of Search ..... 188/65.1, 65.2, 65.3, 188/65.4, 65.5; 182/5, 3, 4, 6, 7, 9, 10, 11, 240, 235, 231

[56] References Cited

U.S. PATENT DOCUMENTS

| | | | |
|---|---|---|---|
| 387,650 | 8/1888 | Lovejoy | 188/65.3 |
| 899,984 | 9/1908 | Huffman | 188/65.3 |
| 1,188,991 | 6/1916 | Putman | 182/278 |
| 1,591,584 | 7/1926 | Vishner | 188/65.1 |
| 1,831,068 | 11/1931 | Hayslip | 182/133 |
| 2,226,937 | 12/1940 | Masset | 188/65.1 |
| 2,758,887 | 8/1956 | Herod | 182/5 |
| 3,220,511 | 11/1965 | Holkesvick | 188/65.4 |
| 3,550,726 | 12/1970 | Chezem | 188/65.4 |

FOREIGN PATENT DOCUMENTS

| | | | |
|---|---|---|---|
| 52377 | 2/1912 | Austria | 188/65.3 |
| 4687 | 3/1892 | Switzerland | 188/65.2 |

*Primary Examiner*—Reinaldo P. Machado
*Assistant Examiner*—Alvin Chin-Shue
*Attorney, Agent, or Firm*—Charles E. Wills

[57] ABSTRACT

A descent device for sliding frictional engagement with a rope and including an elongate vertical shaft with a head structure at the upper end of the shaft and a base structure at the lower end of the shaft. Both structures contain u-shaped, rope receiving slots having an inner wall and opposed side walls. A removable tubular shell extends over the head and base structures to close the rope-receiving slots.

One of said rope-receiving slots contains a brake shoe which is movable between a retracted position in which the outer surface thereof is contiguous with the inner wall of the slot and an extended position in which said outer surface is adjacent to the tubular shell so as to retain the rope between said shell and the brake shoe. The brake shoe is yieldably biased toward the extended position, and an external handle is provided for manually moving the brake shoe to the retracted position.

A bale wire can also be provided on the shell for maintaining the handle in the retracted position, and an adjusting screw can also be provided adjacent the brake shoe actuating rod to maintain the brake shoe in selected adjusted positions between the retracted position and the fully extended position.

7 Claims, 10 Drawing Figures

DESCENT WITH MANUALLY OPERABLE BRAKE

BACKGROUND AND BRIEF SUMMARY OF THE INVENTION

This invention pertains generally to descent devices, and more particularly to a novel descent device with manually operable brake means to control the descent of the device (and a load) along a suspended line.

It is old in the arts of handling and moving of work with the aid of ropes and lines, to utilize various forms of friction devices to slow and/or to control the relative movement of related lines and work. One group of friction devices consists of those with cylindrical shafts about which lines are wrapped or wound so that a desired frictional drag is produced between the shaft and the line as the line is caused to slide about the shaft under work loads. In one sub-group of such devices, the devices are fixed in position and the lines are moved relative thereto, while in another sub-group, the lines are anchored and the devices move along the line. It is the second sub-group of friction devices with which the present invention is concerned.

The art of descent devices was extremely active and became highly developed throughout the years between about 1875 and about 1925. During those years, such devices were especially designed for use by persons endeavoring to escape from buildings during a fire, and consisted of ropes or lines anchored within the upper stories of the buildings and caused to freely depend at the exterior of the buildings, and descent devices of the type referred to above, engaged with the lines and which the persons exiting the buildings gripped or fastened themselves to and which operated to slow their descent down and along the line.

The above-noted type of descent devices has continued to be used throughout the years and U.S. Pat. Nos. 147,828, 289,050, 292,981 and 386,237 disclose devices of the type with which the present invention is concerned, and show the state of the art prior to the 1900's.

A major deficiency found to exist in the aforesaid descent devices resides in the fact that the devices must be set to normally afford insufficient friction to prevent rapid movement down their related lines and that controlled movement down the lines is achieved by the application of additional friction produced by the users of the devices, as by manually engaging portions of the lines about cleats on the devices and manually drawing the line about the cleats to increase or decrease the frictional drag as required. This not only requires that at least one hand of the user be used to control the operation of the device, but it further requires the exercise of special skills which require special talent and practice to perfect.

A more serious deficiency of the prior art descent devices resides in the fact that if the line should become displaced from the cleat or if the user of the device should lose his grip on the line, uncontrolled free and hazardous descent down the line is likely to result.

In efforts to overcome the above deficiencies, the prior art has taught the use of descent devices with various kinds of manually controlled braking means to enable the users of the devices to control their rate of descent down related lines. Two of these braking means are disclosed in U.S. Pat. No. 536,866 issued Apr. 2, 1895, and U.S. Pat. No. 1,187,754 issued June 20, 1916. Although U.S. Pat. No. 536,866 contains the statement that the brake acts automatically, it is obvious that the only "automatic" force applied to the rope A is the weight of the handle F, which appears to be insignificant, and which actually requires the handle to be manually pulled downwardly by the user to effect a braking action. U.S. Pat. No. 1,187,754 also requires the brake means to be manually applied. Thus, the shaft 10 about which the line is wrapped is of tapered construction; a corresponding tapered sleeve 17 is engaged about the shaft and the line; and cam means actuated by the handle 37 is utilized to shift the sleeve relative to the shaft and into and out of pressure frictional engagement with the line about the shaft.

With the aforegoing limitations and deficiencies of known devices in mind, it is an object of the present invention to provide a novel descent device with manually operable brake means whereby the device is held stationary on the rope and must be manually actuated by the user to provide for a controlled rate of descent.

A further object of the present invention is to provide a descent device of the general character referred to above, in which the control means presents no major projections with which a related line is likely to become entangled or which is likely to cause injury or damage to a person or to objects with which the device may come into contact.

Yet another object of the present invention is to provide an improved descent device wherein the control means is of the "dead-man" type, such that the manual actuation of the control means is necessary to effect controlled descent of the device and its load down a related line, and which is such that loss of manual control of the control means results in stopping movement of the device or results in a predetermined set slow movement down the line.

It is yet another object of the present invention to provide an improved descent device which, in an alternative form, includes manually releasably latch means to hold the control means in brake-released position, and which further includes means to adjust the control means whereby the device can be made to move down its related line at a controlled rate of speed.

Furthermore, it is an object of the present invention to provide an improved descent control device which is easy and economical to manufacture, easy and convenient to use, and which is highly effective and dependable in operation.

The foregoing and other objects and features of the invention will be fully understood from th following detailed description of a typical preferred form and embodiment of the invention, throughout which description reference is made to the accompanying drawings.

DETAILED DESCRIPTION OF THE INVENTION

Figure 1:
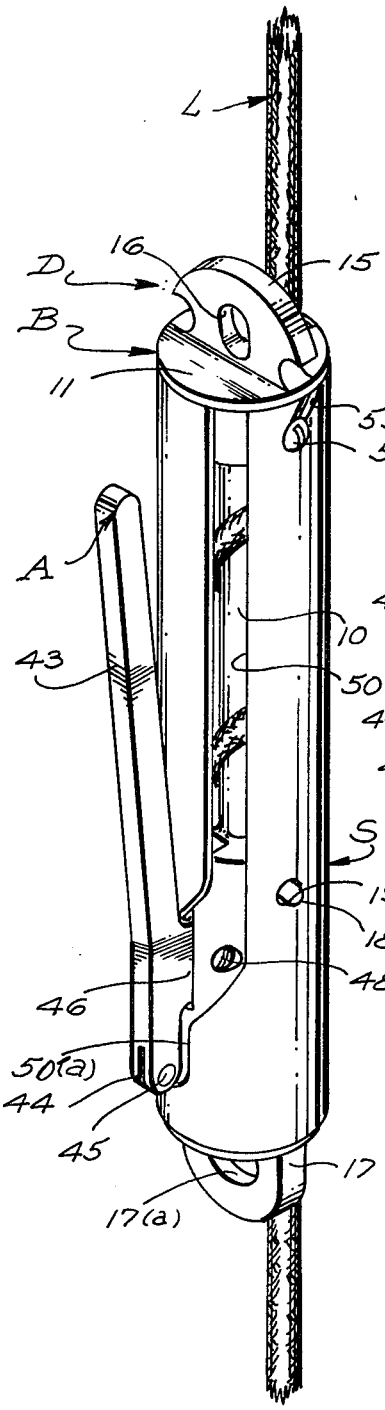
FIG. 1 is an isometric view of a descent device constructed in accordance with the teachings of the present invention, shown in engagement with the depending line.

The descent device D illustrated in the drawings and embodying the present invention, includes an elongate, vertical-extending body B comprising an elongate central shaft 10 of minor diameter, a large diameter cylindrical head 11 at the upper end of the shaft 10 and a large diameter cylindrical base 12 at the lower end of the shaft 10. The head 11 and base 12 have radially outwardly and vertically extending line guide recesses 13 and 14. The recesses 13 and 14 are radially outwardly offset from the central axis of the shaft 10 and are shown as having semi-circular inner sides or bottoms and flat, parallel opposite sides.

The head 11 has an upwardly projecting combination cleat and eye fixture 15 formed integral thereon. The cleat and eye fixture 15 is provided with a through-opening 16 to effect coupling of the upper end of the device with a related structure, as circumstances might require.

The base 12 of the body B is shown as having a downwardly extending eye fixture 17 formed integrally thereon with a through-opening 17(*a*) to facilitate securing the lower end of the device to a body harness or chair seat belt worn by a person using the device.

The device D further includes an elongate, cylindrical, tubular shell S with upper and lower end portions slidably engaged about the head 11 and base 12 of the body B and extending therebetween in radial spaced relationship about the shaft 10. The upper and lower ends of the sleeve-like shell normally overlie and close the outer open sides of the line receiving recesses 13 and 14, and the central portion of the shell cooperates with the shaft to define an annulus in which a related line, wrapped about the shaft is received.

It is to be noted that the parts or portions of the shell overlying and closing the recesses 13 and 14 cooperate with those recesses to define what can can be properly called vertically extending line guide openings at the upper and lower ends of the body.

Figure 2:
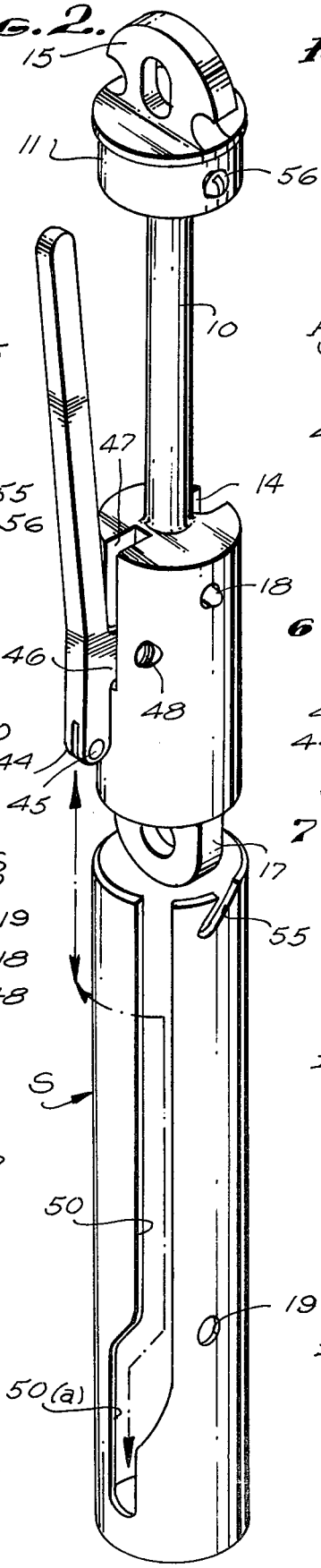
FIG. 2 is a partial "exploded" view of the device shown in FIG. 1.

The shell S is releasably secured to the body B in such a manner that when it is released, it can be moved axially downwardly relative thereto, to open the recesses 13 and 14 and to provide free access to the shaft 10, as shown in FIG. 2 of the drawings. In the construction illustrated, the base 12 carries a manually depressible, spring-loaded bullet latch 18 and the shell S has an opening 19 to receive the bullet latch when the shell is in working position, thereby releasably holding the shell in that position.

A flexible line L, such as of braided nylon material, is arranged substantially parallel with the body B, with upper and lower portions thereof descending through the recesses 13 and 14, and with its central portion wound about the shaft 10. The number of turns of the line L about the shaft 10 determines the frictional resistance to relative movement between the device D and the line L. The number of turns can be changed to adjust the device to handle different loads, as by merely depressing the bullet latch 18 and sliding the shell S downwardly to open the line guide recess 13 at the top of the body, and thereby attain free access to the shaft 10. The device D thus far described is generally the same as the commercially available "SKY GENIE" descent device which is shown and described in U.S. Pat. No. 3,250,515.

In addition to the foregoing features, the present descent device D which embodies the teaching of the present invention, further includes a line-engaging brake shoe 20, a spring means M to act on the brake shoe, and a manually engageable actuating lever A to move the brake shoe relative to the line and against the force exerted by the spring means M. The brake shoe 20, the spring means M and the actuating means A (FIG. 3) establish a manually operable control means which can be operated to stop or control the rate of relative movement between the device and the line.

The brake shoe 20 is an elongate, vertically extending, bar-like part, received in a radially outwardly opening cavity 21 formed in the base 12 at the radiused inner side or bottom of the recess 14. The shoe 20 is shiftable radially in the cavity from a normal outer or unactuated holding position where it projects into the recess 14 to engage and hold the line L in tight engagement against the inside surface of the shell, to an inner actuated position where it is received within the cavity 21 and is out of pressure engagement with the line L.

Figure 8:
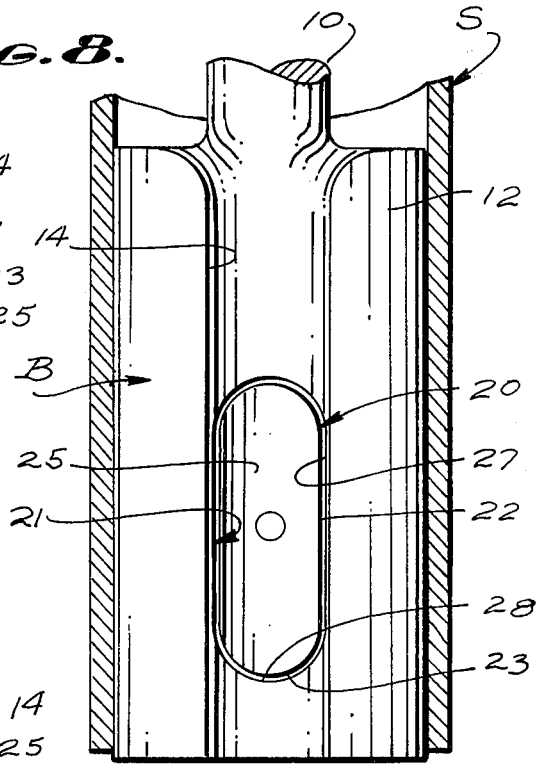
FIG. 8 is a fragmentary, longitudinal view partially in cross section, taken as indicated by line 8—8 on FIG. 7.

In the form of the invention illustrated (FIGS. 6, 7 and 8), the shoe 20 has parallel sides 22, semi-circular upper and lower ends 23, a flat, inner surface 24 and an axially extending, radially outwardly disposed semi-circular line engaging surface 25. The outer line engaging surface 25 corresponds with the semi-circular bottom surface of the recess 14 and cooperatively engages the line L to maintain the line aligned with the shoe and with the central radial plane of the recess 14 when the construction is in its unactuated or outermost position.

The cavity 21 has a flat, radially outwardly disposed bottom 26 opposing the inner surface 24 of the shoe and has side and end surfaces 27 and 28 which oppose and slidably engage the sides and ends 22 and 23 of the shoe, whereby the shoe is effectively retained in the cavity and against displacement relative to the base 12 and for free radial shifting betwen its normal or unactuated position and its actuated position.

Figure 3:
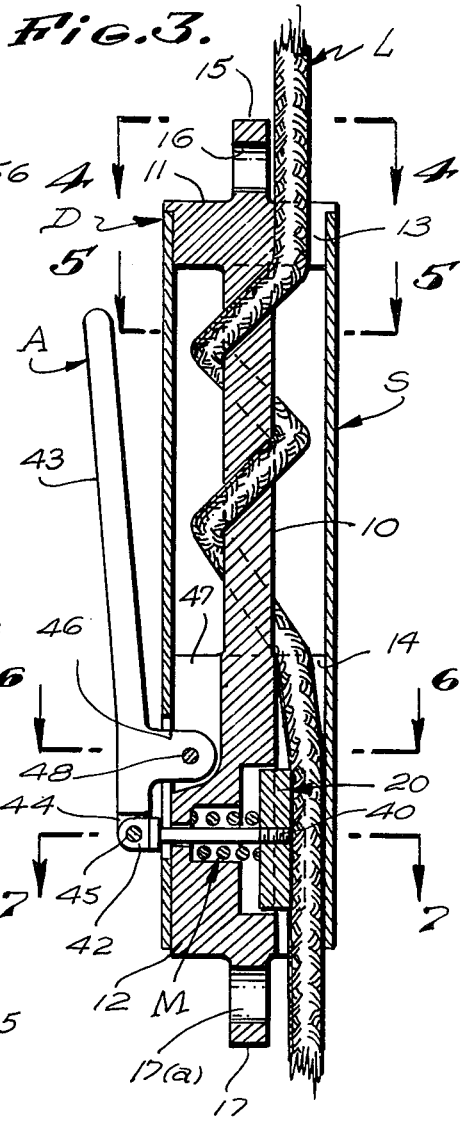
FIG. 3 is a longitudinal sectional view taken substantially as indicated by line 3—3 on FIG. 1.
Figure 4:
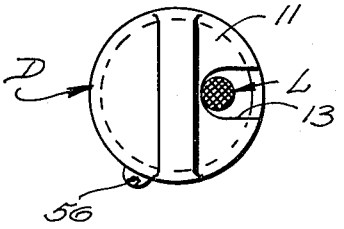
FIG. 4 is an end view taken as indicated by line 4—4 in FIG. 3.
Figure 5:
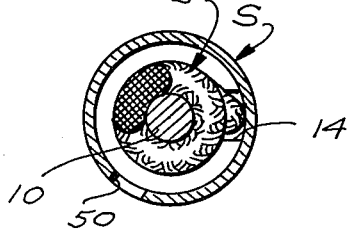
FIG. 5 is a transverse sectional view taken as indicated by line 5—5 on FIG. 3.
Figure 7:
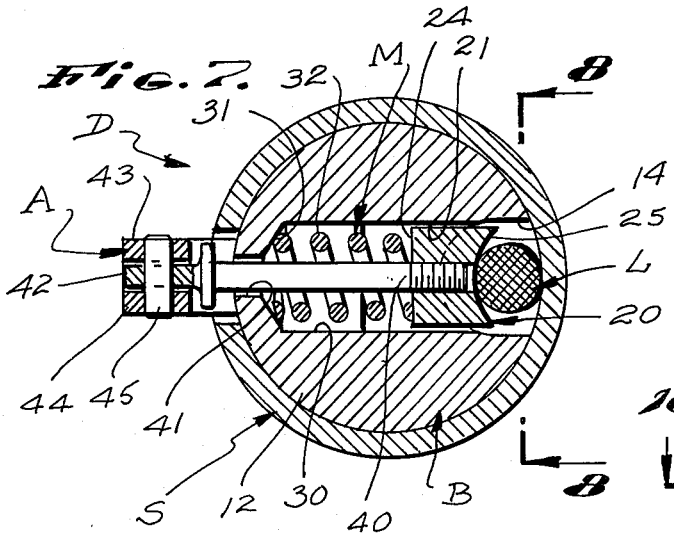
FIG. 7 is an enlarged cross-sectional view taken as indicated by line 7—7 on FIG. 3.

The spring means M includes a cylindrical, radially extending bore 30 (FIG. 7) entering the bottom 26 of the cavity between the upper and lower ends thereof and terminating at a bottom 31 within the base. The means M further includes an elongate helical compression spring 32 extending radially in the bore 30 with one end stopped at the bottom 31 of the bore and its other end engaging the inner surface of the shoe, as shown in FIGS. 3 and 7 of the drawings.

It will be apparent that the spring means M normally yieldably urges the shoe out of the cavity 21 and into the recess 14 to engage and hold that line in tight, clamped engagement between the shoe and the shell. More specifically, the shoe 20 holds the line L in clamped engagement with the radial outer side of the line guide opening in the lower end portion of the device, which opening is defined by the recess 14 and the shell S.

The manually engageable actuating means A for moving the brake shoe 20 relative to the line L and against the force of the spring means M, includes an elongate radially extending rod 40 (FIG. 7) with one end threadedly engaged in the shoe 20. The rod 40 extends inwardly from the shoe, concentrically with and through the bore 30 and spring 32 of the means M and thence out through a radial opening 41 in the side of the base 12 opposite the recess 14. The outer end of the rod 40 is formed with an apertured head 42 in the nature of an apertured clevis tongue.

Figure 6:
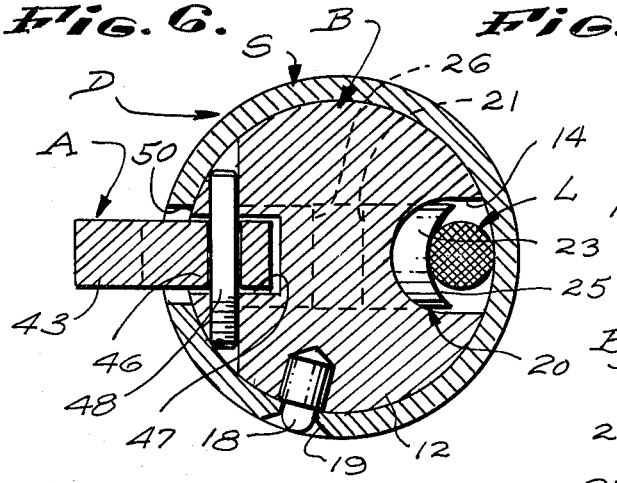
FIG. 6 is an enlarged cross-sectional view taken as indicated by line 6—6 on FIG. 3.

The means A further includes an elongate outwardly inclined lever arm 43 (FIG. 3) with a clevis 44 formed at its lower end and engaged with and pivotally coupled to the head 42 on the rod by means of a pivot pin 45. The lower end portion of the lever arm 43 is provided with a radially inwardly projecting apertured fulcrum leg 46 above the pivot arm 45, which projects radially inwardly into a radially outwardly opening slot 47 formed in the base 12 of the body B (diametrically opposite the recess 14) and is pivotally coupled with the base and within said slot by means of a pivot pin 48 carried by the base on a horizontal axis spaced above and normal to the axis of the rod 40. The pin 48 extends through the slot 47 and the apertured leg 46, as shown in FIG. 6 of the drawings.

The force of the spring means M acting on the shoe 20 and through the rod 40 yieldable biases the lower end portion of the lever arm 43 radially inwardly, pivoting the rod about the axis of the pin 48 and moving the upper end of the arm 43 radially outwardly relative to the central vertical axis of the device to its unactuated position.

Upon the user manually engaging and urging the upper end portion of the lever arm 43 radially inwardly, the lower end of the arm is pivoted outwardly, thereby moving the outer end of the rod 40 radially outwardly and moving the shoe 20 at the inner end of the rod radially inwardly against the force of the spring means M, and out of pressure engagement with the line L. By controlled movement of the shoe 20 in the manner set forth above, the frictional drag between the shoe and the line can be reduced to any desired extent, or can be totally eliminated if desired.

In practice, the radial movement of the shoe 20 between its unactuated holding position and its actuated position is relatively small, and therefore the required pivotal movement of the lever arm 43 to effect that movement is correspondingly small. Accordingly, the upper hand-engaging portion of the lever arm 43 diverges upwardly and outwardly relative to the central vertical axis of the device at a slight angle of, for example, 5° or 10°. With this relationship of parts, the lever arm 43 normally occurs in such close and parallel relationship with the external surface of the shell S, whereby the upper end portion of the lever arm and the upper end of the shell S can be grasped with one hand, for actuating the lever arm and the brake shoe.

It is to be further noted that the close relationship of the lever arm 43 with the shell S is such that the lever arm does not create an objectionable and troublesome obstruction with which the line L is likely to become entangled or which is likely to catch on or damage objects contacting or contacted by the device.

Because the fulcrum leg 46 of the lever arm must project through the shell S the shell is provided with an elongate radially and vertically opening slot 50 to accommodate the leg 46 and to allow for axial movement of the shell S downwardly relative to the body. In practice, provision of the slot 50 is desirable because it enables the user to visually inspect and to count the number of turns of the line L about the shaft 10. Thus, the user can readily determine that the construction is in proper working order and can determine whether or not there is a sufficient number of turns on the line L about the shaft 10 to properly handle his weight.

In the form of the invention illustrated, the lower end portion 50(*a*) of the slot 50 is circumferentially offset from the upper portion of the slot so that the upper portion of the slot is offset from the lever arm 43. With such a relationship, the lever arm 43, when fully actuated, is stopped by the shell S and the possibility of the arm being moved radially inwardly through the slot and into the interior of the shell is eliminated.

In practice, and as shown in the drawings (FIGS. 1 and 2), an orienting slot 55 can be provided in the upper end of the shell S and a retaining pin or screw 56 can be carried by the head 11 of the body B to engage in the slot 55. Such a slot and retaining screw arrangement serve to lock the upper end of the shell to the head 12.

With the construction thus far described and assuming that the frictional resistance afforded by the turns of the line L about the shaft 10 is insufficient to provide a safe rate of descent of the device and the user down the line, it will be apparent that the control means here provided normally clamps the line L within the lower end portion of the device to stop downward movement of the device relative to the line and thereby releasably stop the descent of the user. It will be further apparent that upon manual gripping of the device in one hand, the user can actuate the control means to reduce or release the clamping force exerted on the line L and can thereby control his descent down the line in a safe and controlled manner. Should the user lose his grip on the device or lose consciousness, the control means automatically reestablishes tight braking engagement with the line, thereby stopping his descent.

If it is desired to deactivate the braking shoe, a releasable latch means L (FIG. 9) can be provided to releasably hold the control means in its full actuated position with the upper end of the handle member adjacent the sleeve. In such an arrangement, the device D becomes a descent device which is similar in operation to and can be used like a descent device provided by the prior art.

Figure 9:
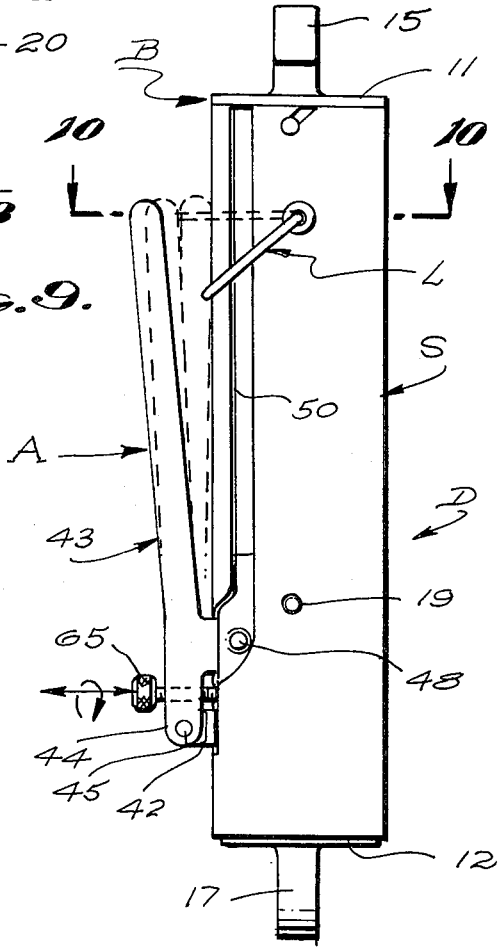
FIG. 9 is an elevational view of an alternative form of device, with additional features.
Figure 10:
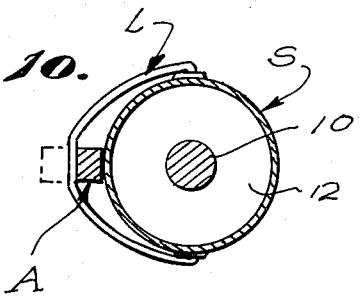
FIG. 10 is a cross-sectional view taken substantially as indicated by line 10—10 on FIG. 9.

As shown in FIGS. 9 and 10 of the drawings, the latch means L comprises a bale wire 60 pivotally carried by the shell S and movable into and out of engagement over and with the upper end portion of the lever arm 35 when the lever arm is held in its actuated position.

Further, and as shown in FIG. 9, the device can include a manually operable adjusting screw 65 carried by the lower end portion of the lever arm 43 between the pivotal axis 48 of the arm and the pivot pin 45 and engaging the base 12 of the body B.

The adjusting screw is an adjustable stop which limits radial outward movement of the shoe 20 in the body B, and which therefore limits the clamping force exerted by the shoe against the line L. Thus, by suitable adjusting of the screw 65, the user of the device can effectively adjust and set the control means so that when it is in its unactuated position, sufficient frictional drag is provided by the control means so that he will automatically descend down the line L at a desired slow and controlled rate. Further, the screw 65 can be set so that should the load exceed some predetermined amount, descent of the device and the load carried by it will commence independent of manual actuation of the control means.

While the provision of the means L and the adjusting screw 65 is not likely to be required in all instances, it is recognized that there exists a number of special circumstances where the provision of either or both the latch means and setting screw would be highly advantageous and desirable.

Having described only the preferred forms and application of the invention, I do not wish to be limited to the specific details herein set forth but reserve to myself any modifications and/or variations that might appear to those skilled in the art and which fall within the scope of the following claims.

I claim:

1. In combination with a descent control device for use by humans for downward sliding frictional engagement with a rope and including an elongate vertical shaft for receiving turns of rope thereabout to provide frictional resistance to such movement, a head structure at the upper end of the shaft, a base structure at the lower end of the shaft, an ourwardly opening upper rope guide passageway in the head structure containing a curved inner wall and opposed side walls, an outwardly opening lower rope guide passageway in the base structure containing a curved inner wall and opposed side walls, and a tubular shell in engagement with the head structure and the base structure enclosing the upper and lower rope guide passageways, rope braking means, comprising:

a recess in the inner wall of one of said rope guide passageways;

a brake shoe having an outer face of generally the same contour as said inner wall received in said recess and movable between a retracted position in which said outer face is in general surface alignment with the inner wall of the passageway, and an extended position in which the outer face is spaced outwardly of said inner wall for restraining the rope between said outer face and the tubular shell;

means yieldably biasing the brake shoe to the extended position; and actuating means interconnected with the brake shoe for moving it to the retracted position.

2. A descent control device with rope braking means as described in claim 1, in which the actuating means includes:

an elongate handle member having an upper end and a lower end with a fulcrum projection intermediate the upper and lower ends;

means pivotally mounting the fulcrum projection on the structure which contains the recess for receiving the brake shoe; and means interconnecting one end of the handle member with the brake shoe for moving it between the extended position and the retracted position.

3. A descent control device with rope braking means as described in claim 1, in which the actuating means includes:

an elongate handle member having an upper end and a lower end with a fulcrum projection therebetween;

means pivotally mounting the fulcrum projection on the structure which contains the recess for receiving the brake shoe;

a counterbore in said structure in axial alignment with the recess which receives the brake shoe, said counterbore having an end wall adjacent the handle member;

a coiled spring positioned in the counterbore between said end wall and the brake shoe, yieldably biasing said shoe toward the extended position; and means interconnecting one end of the handle member with the brake shoe.

4. A descent control device with rope braking means as described in claim 3, in which the recess for receiving the brake shoe is in the base structure at the lower end of the shaft; the lower end of the handle member is interconnected with the brake shoe; and the upper end of the handle member is in close proximity with the upper end of the tubular shell, whereby the upper end of the handle member and the tubular shell can be grasped with one hand of a user.

5. A descent control device with rope braking means as described in claim 4, which further includes an arcuate bale member having the ends thereof pivotally mounted on the upper end of the tubular shell adjacent to the upper end of the handle member, whereby the brake shoe is retained in the retracted position by engaging the bale member over the upper end of the handle member.

6. A descent control device with rope braking means as described in claim 3, in which the means interconnecting one end of the handle member with the brake shoe comprises a rod having one end thereof connected to the brake shoe and the other end pivotally connected to said one end of the handle member; and which further includes adjusting means mounted on the handle member adjacent the pivotal connection of the rod with the handle to maintain said pivotal connection at selected distances from the structure which contains the recess for receiving the brake shoe, whereby said brake shoe is positioned between the retracted position and the extended position for automatically controlling the rate of descent of a predetermined load without actuating the handle member.

7. A descent control device with rope braking means as described in claim 6, in which the adjusting means comprises a threaded bolt received in the handle member and having an inner end in engagement with the outer surface of the tubular shell and an outer end which extends beyond the outermost surface of the handle member for manual rotatable adjustment of the position of the threaded bolt.

* * * * *